US009091406B2

(12) United States Patent
Sheu

(10) Patent No.: US 9,091,406 B2
(45) Date of Patent: Jul. 28, 2015

(54) VEHICLE HEADLAMP WITH LASER LIGHTING SOURCE

(71) Applicant: HON HAI PRECISION INDUSTRY CO., LTD., New Taipei (TW)

(72) Inventor: Yi-Zhong Sheu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 26 days.

(21) Appl. No.: 13/859,742

(22) Filed: Apr. 10, 2013

(65) Prior Publication Data

US 2014/0177250 A1 Jun. 26, 2014

(30) Foreign Application Priority Data

Dec. 26, 2012 (TW) ..... 101149943 A

(51) Int. Cl.
*F21S 8/10* (2006.01)

(52) U.S. Cl.
CPC ..... *F21S 48/1757* (2013.01); *F21S 48/1159* (2013.01)

(58) Field of Classification Search
CPC ..... H01J 9/025; H01J 31/123; H01J 1/304
See application file for complete search history.

(56) References Cited

U.S. PATENT DOCUMENTS

| | | | | |
|---|---|---|---|---|
| 2005/0105301 | A1* | 5/2005 | Takeda et al. | 362/545 |
| 2009/0046474 | A1* | 2/2009 | Sato et al. | 362/466 |
| 2011/0080751 | A1* | 4/2011 | Mochizuki | 362/530 |
| 2011/0280039 | A1* | 11/2011 | Kishimoto | 362/554 |
| 2012/0106178 | A1* | 5/2012 | Takahashi et al. | 362/459 |
| 2012/0106186 | A1* | 5/2012 | Kishimoto et al. | 362/510 |

* cited by examiner

*Primary Examiner* — Elmito Breval
(74) *Attorney, Agent, or Firm* — Novak Druce Connolly Bove + Quigg LLP

(57) ABSTRACT

A vehicle headlamp includes a laser lighting source and a controlled reflector module. The controlled reflector module is arranged on a light path of the laser lighting source to reflect a laser beam emitted from the laser lighting source to an outside of an vehicle to illuminate. The controlled reflector module includes a motor, a rotor and a reflector. The rotor is used for connecting the motor with the reflector. The reflector rotates rapidly with the rotor controlled by the motor to change the illuminated area of the reflector. The headlamp has a uniformly distributed lighting beam and high luminance, and the size of the headlamp is small.

10 Claims, 9 Drawing Sheets

VEHICLE HEADLAMP WITH LASER LIGHTING SOURCE

BACKGROUND

1. Technical Field

The present disclosure relates to lamps, and more particularly to a headlamp of a vehicle which uses a laser as a lighting source.

2. Description of Related Art

A conventional vehicle headlamp such as a tungsten-halogen headlamp, high-intensity discharge headlamp, an LED headlamp and so on, generally generates a headlight with a large light field distribution which has a radiation angle of 100 degrees (±50 degrees).

The distribution of intensity of the light field of the conventional vehicle headlamp lacks uniformity; the light emitted from the conventional vehicle headlamp is mainly concentrated at a center area. The light at a periphery of the light field of the conventional vehicle headlamp is relatively poor in intensity and unable to illuminate effectively. In order to utilize the light efficiently, a large reflector is employed in the vehicle headlamp. However, the size of the reflector is so large that the vehicle headlamp occupies a large space. Furthermore, such a large reflector causes the headlamp to have a complicated structure. In addition, even applying a reflector in the vehicle headlamp, it is still difficult for an experienced designer to achieve a satisfied distribution of the light field easily and quickly.

Further, the light intensity of the conventional vehicle headlamp is not high enough for a safe driving.

Accordingly, it is desirable to provide a vehicle headlamp which can overcome the described limitations.

DETAILED DESCRIPTION

Embodiments of the vehicle headlamp will now be described in detail below and with reference to the drawings.

Figure 1:
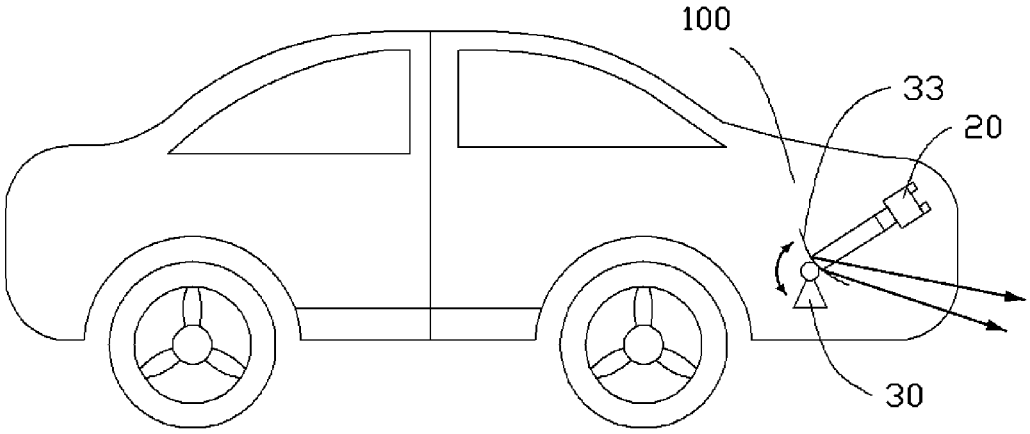
FIG. 1 is a schematic view of a vehicle headlamp of a first embodiment of the present disclosure.
Figure 2:
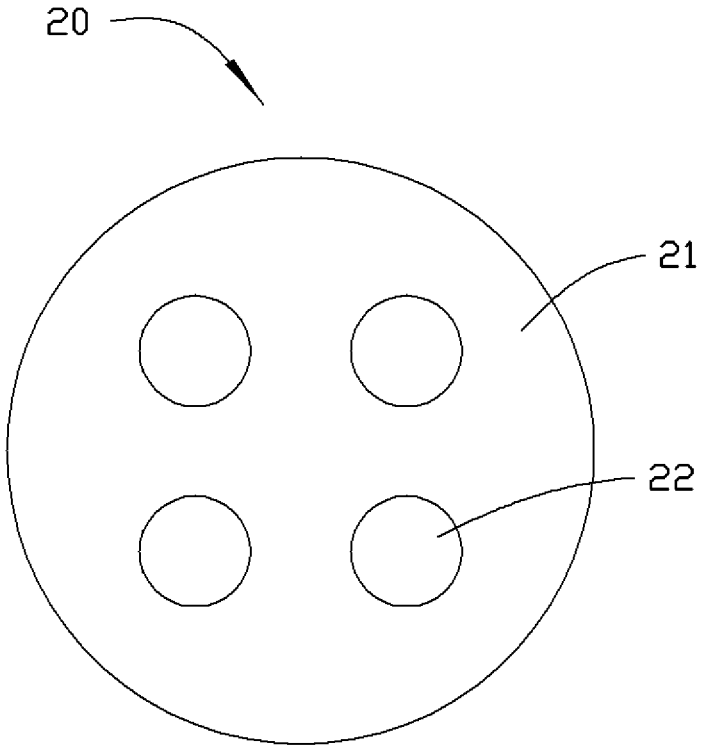
FIG. 2 is a schematic view of a light source of the vehicle headlamp in FIG. 1.
Figure 3:
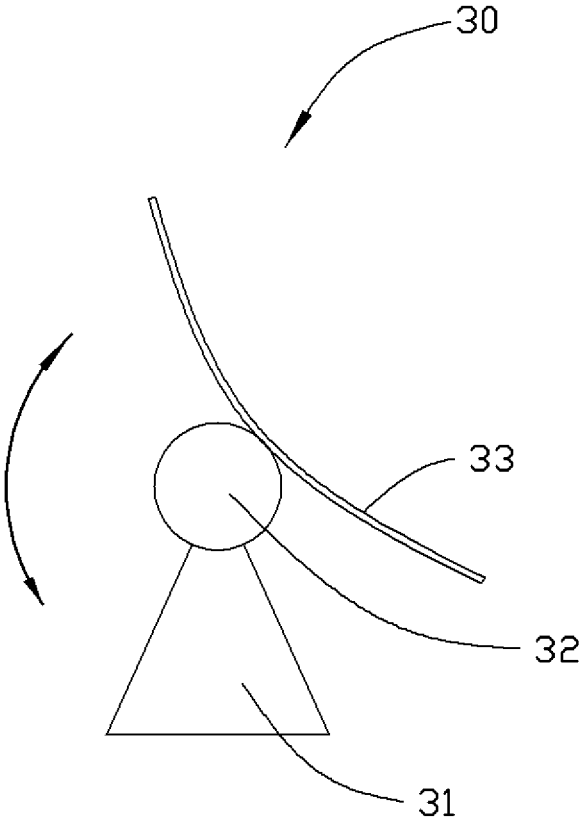
FIG. 3 is a schematic view of a controlled reflector module of the vehicle headlamp in FIG. 1.

Referring to FIGS. 1-3, a vehicle headlamp 100 according to the first embodiment of the present disclosure is shown. The vehicle headlamp 100 includes a laser lighting source 20 and a controlled reflector module 30, wherein the laser lighting source 20 and the controlled reflector module 30 are installed inside of a vehicle shown in FIG. 1.

The laser lighting source 20 includes a base 21 and one or more laser diodes 22 mounted on the base 21. The laser lighting source 20 is connected to a power supply (not shown), such as a storage battery of the vehicle. The light emitted from the laser diodes 22 is a laser beam. A central portion and a periphery of the laser beam have a uniform and high illumination intensity.

The controlled reflector module 30 is arranged on a light path of the laser lighting source 20, and reflects the laser beam emitted from the laser lighting source 20 to the outside of the vehicle to illuminate. The controlled reflector module 30 includes a motor 31, a rotor 32 and an arced reflector 33. The rotor 32 is connected between the motor 31 and the arced reflector 33. The light incident side of the arced reflector 33 orientates to the laser lighting source 20; that is, the reflecting surface of the arced reflector 33 faces the laser lighting source 20. The reflecting surface is a concaved surface. The reflection direction of the arced reflector 33 orientates to the outside of the vehicle. The motor 31 is connected to the power supply, such as the storage battery of the vehicle, so the arced reflector 33 can be rotated (swiveled) around the rotor 32 by the driving of the motor 31. The arced reflector 33 rotates rapidly with the rotor 32 controlled by the motor 31 to change the illuminated area of the arced reflector 33 by the laser lighting source 20 whereby a large illuminate field in front of the vehicle can be obtained.

The size of reflecting surface of the arced reflector 33 is determined by the size of the light beam. It is understood that the light emitted from the laser lighting source 20 can be entirely reflected by the arced reflector 33. Via choosing different base 21 or different arced reflector 33, or via adjusting the distance between the laser lighting source 20 and the arced reflector 33 or the rotating orbit of the rotor 32, the vehicle headlamp 100 with laser lighting source 20 could have a uniform distributed lighting beam and high luminance, and the size of the vehicle headlamp 100 is also decreased because of the small size of the laser lighting source 20.

Figure 4:
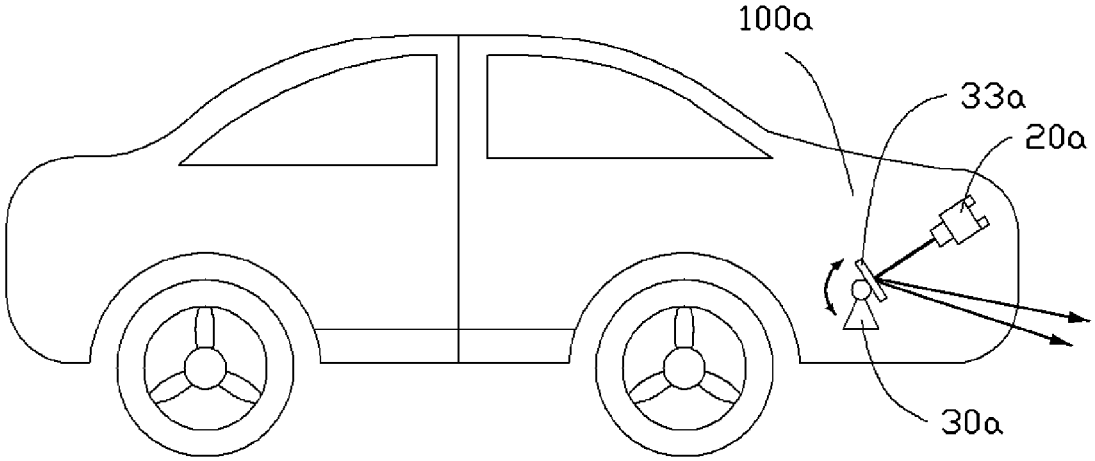
FIG. 4 is a schematic view of a vehicle headlamp of a second embodiment of the present disclosure.
Figure 5:
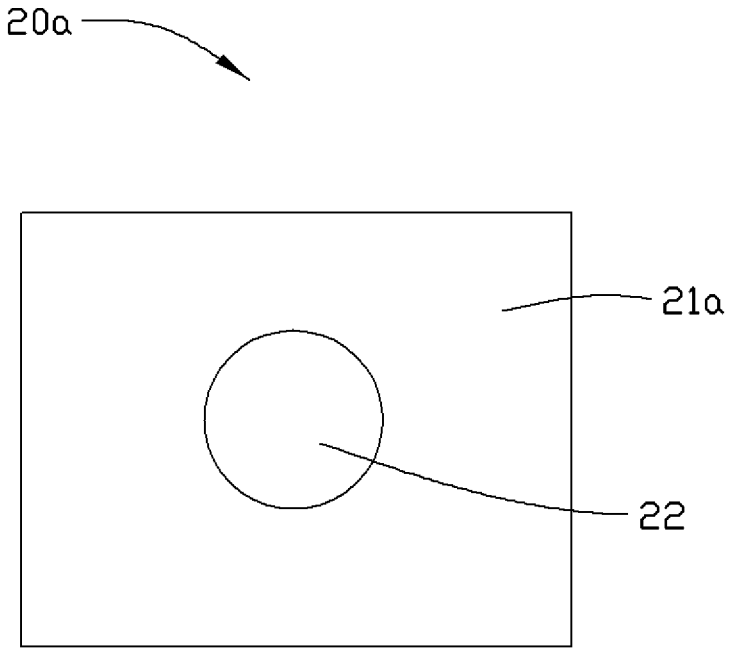
FIG. 5 is a schematic view of a light source of the vehicle headlamp in FIG. 4.
Figure 6:
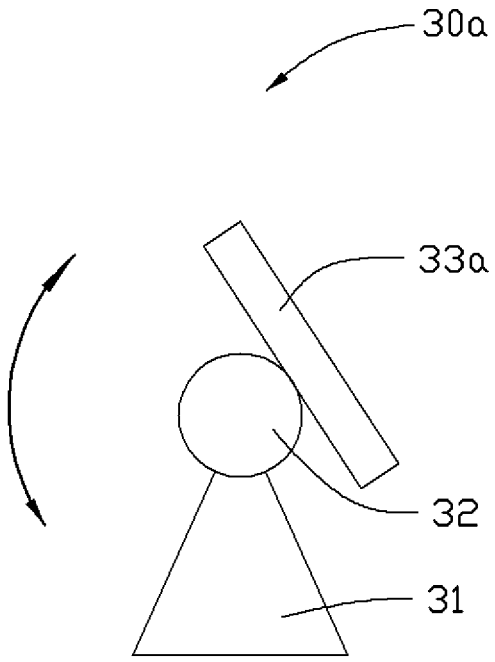
FIG. 6 is a schematic view of a controlled reflector module of the vehicle headlamp in FIG. 4.

Referring to FIGS. 4-6, a vehicle headlamp 100*a* according to the second embodiment of the present disclosure is shown. The vehicle headlamp 100*a* includes a laser lighting source 20*a* and a controlled reflector module 30*a*, and the laser lighting source 20*a* and the controlled reflector module 30*a* are installed inside of a vehicle shown in FIG. 4.

The laser lighting source 20*a* includes a base 21*a* and one laser diode 22 mounted on the base 21*a*. The laser lighting source 20*a* is connected to a power supply (not shown), such as a storage battery of the vehicle. The light emitted from the laser diode 22 is a laser beam. A central portion and a periphery of the laser beam have a uniform and high illumination intensity.

The controlled reflector module 30*a* is arranged on a light path of the laser lighting source 20*a*, and reflects the laser beam emitted from the laser lighting source 20*a* to the outside of the vehicle to illuminate. The controlled reflector module 30*a* includes a motor 31, a rotor 32 and a plane mirror 33*a*. The rotor 32 is connected between the motor 31 and plane mirror 33*a*. The incident side of the plane mirror 33*a* orientates to the laser lighting source 20*a;* that is, the reflecting surface of the plane mirror 33*a* faces the laser lighting source 20*a*. The reflection direction of the plane mirror 33*a* orientates to the outside of the vehicle. The motor 31 is connected to the power supply, such as the storage battery of the vehicle, so the plane mirror 33*a* can be rotated (swiveled) around the rotor 32 by the driving of the motor 31.

The size of reflecting surface of the plane mirror 33*a* is determined by the size of the light beam. It is understood that the light emitted from the laser lighting source 20*a* can be entirely reflected by the plane mirror 33*a*. Via choosing different base 21 or different plane mirror 33*a*, or via adjusting the distance between the laser lighting source 20*a* and the plane mirror 33*a* or the rotating orbit of the rotor 32, the vehicle headlamp 100*a* with laser lighting source 20*a* could have a uniform distributed lighting beam and high luminance, and the size of the vehicle headlamp 100*a* is also decreased because of the small size of the laser lighting source 20*a*.

Figure 7:
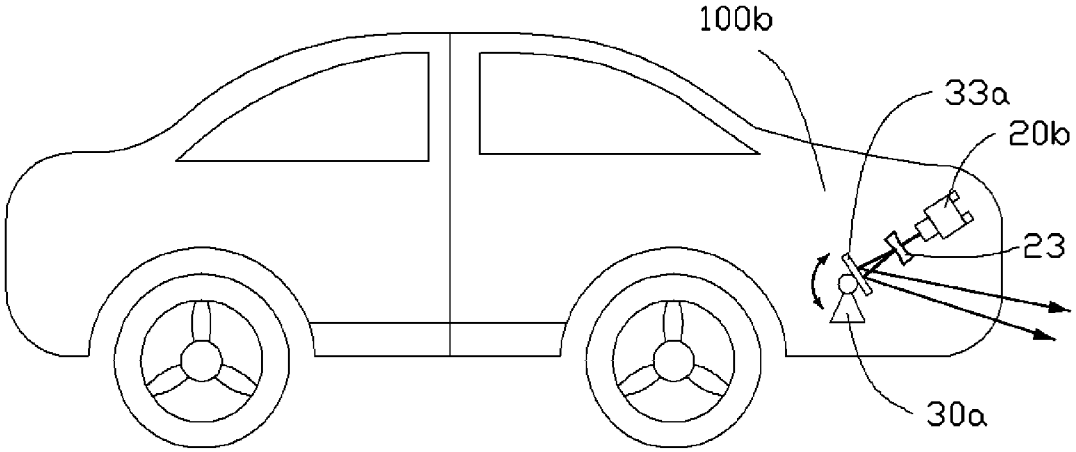
FIG. 7 is a schematic view of a vehicle headlamp of a third embodiment of the present disclosure.
Figure 8:
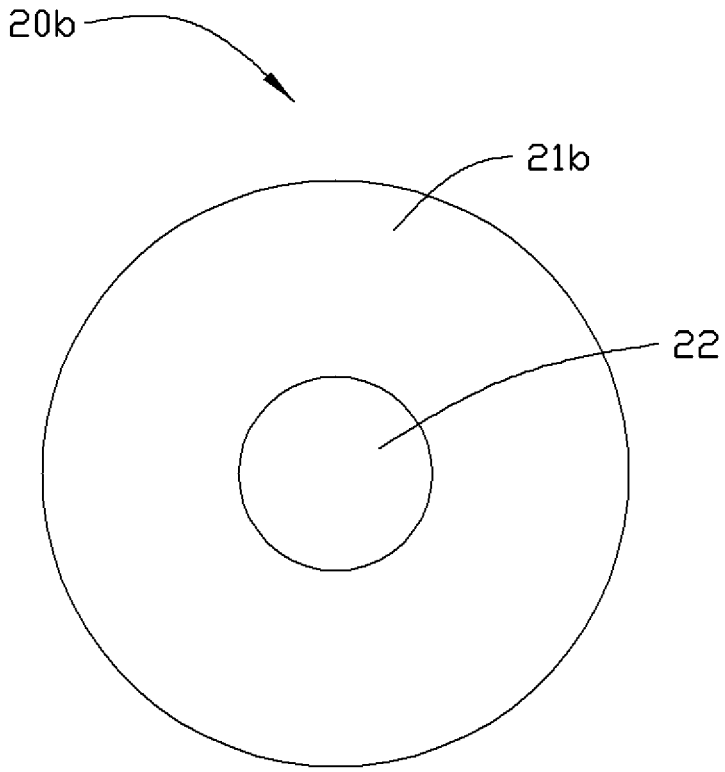
FIG. 8 is a schematic view of a light source of the vehicle headlamp in FIG. 7.

Referring to FIGS. 7-8, a vehicle headlamp 100*b* according to the third embodiment of the present disclosure is shown. The vehicle headlamp 100*b* includes a laser lighting source 20*b* and a controlled reflector module 30*a*, and the laser lighting source 20*b* and the controlled reflector module 30*a* are installed inside of a vehicle shown in FIG. 7.

The laser lighting source 20*b* includes a base 21*b*, a laser diode 22 mounted on the base 21*b*, and a lens 23 arranged on a light path of the laser diode 22. The laser lighting source 20*b* is connected to a power supply (not shown), such as a storage battery of the vehicle. The light emitted from the laser diode 22 is a laser beam. A central portion and a periphery of the laser beam have a uniform and high illumination intensity.

The controlled reflector module 30*a* is arranged on a light path of the laser lighting source 20*b*, and reflects the laser beam emitted from the laser lighting source 20*b* to the outside of the vehicle to illuminate. The controlled reflector module 30*a* includes a motor 31, a rotor 32 and a plane mirror 33*a*. The rotor 32 is connected between the motor 31 and the plane mirror 33*a*. The incident side of the plane mirror 33*a* orientates to the laser lighting source 20*b;* that is, the reflecting surface of the plane mirror 33*a* faces the laser lighting source 20*b*. The reflection direction of the plane mirror 33*a* orientates to the outside of the vehicle. The motor 31 is connected to the power supply, such as the storage battery of the vehicle, so the plane mirror 33*a* can be rotated (swiveled) around the rotor 32 by the driving of the motor 31.

Figure 9:
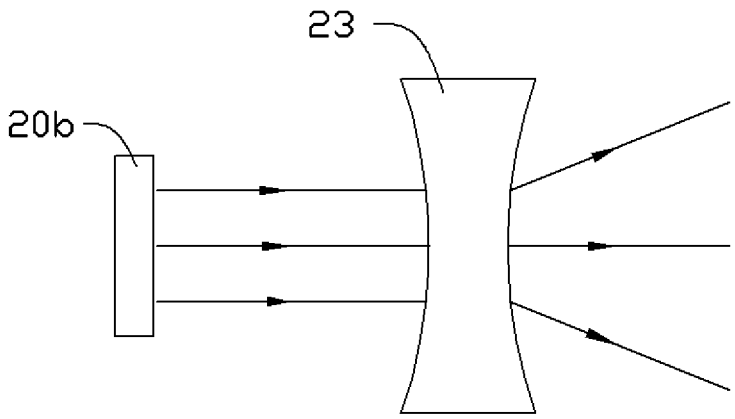
FIG. 9 is a schematic view of the light source of the vehicle headlamp in FIG. 7, showing the light path thereof.

Also referring to FIG. 9, the lens 23 is installed between the laser diode 22 and the controlled reflector module 30*a*, The lens 23 refracts the laser beam emitted from the laser diode 22 to the controlled reflector module 30*a*. The lens 23 is a biconcave lens.

The size of reflecting surface of the plane mirror 33*a* is determined by the lighting size of the lighting beam refracting from the lens 23. It is understood that the lighting beam refracting from the lens 23 can be entirely reflected by the plane mirror 33*a*. Via choosing different base 21, different plane mirror 33*a*, or different lens 23, or via adjusting the distance between the laser lighting source 20 and the plane mirror 33*a*, the distance between the lens 23 and the plane mirror 33*a*, or the rotating orbit of the rotor 32, the vehicle headlamp 100*b* with laser lighting source 20*b* could have a uniform distributed lighting beam and high luminance, and the size of the vehicle headlamp 100*b* is also decreased because of the small size of the laser lighting source 20*b*.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A vehicle headlamp for a vehicle, comprising:

a laser lighting source for emitting a laser beam and configured for being mounted in the vehicle;

a controlled reflector module arranged on a light path of the laser lighting source and configured to be mounted in the vehicle, the controlled reflector module reflecting the laser beam emitted from the laser lighting source to an outside of the vehicle to illuminate, the controlled reflector module comprises a reflector configured and positioned to direct reflected light to the outside of the vehicle; and a lens installed between the laser lighting source and the controlled reflector module, the lens being arranged on the light path of the laser lighting source to refract the laser beam emitted from the laser lighting source to the controlled reflector module, the lens being a biconcave lens.

2. The vehicle headlamp of claim 1, wherein the laser lighting source comprises a base and at least one laser diodes.

3. The vehicle headlamp of claim 1, wherein the controlled reflector module further comprises a motor and a rotor, and the rotor is connected between the motor and the reflector.

4. The vehicle headlamp of claim 3, wherein the reflector is a plane mirror or an arced reflector.

5. The vehicle headlamp of claim 4, wherein the arced reflector rotates with the rotor controlled by motor to change the illuminated area of the reflector by the laser lighting source.

6. The vehicle headlamp of claim 4, wherein the plane mirror is rotated around the rotor by the motor.

7. The vehicle headlamp of claim 3, wherein the incident side of the reflector orientates to the laser lighting source.

8. The vehicle headlamp of claim 3, wherein the motor is configured to be connected to a power supply provided in the vehicle.

9. The vehicle headlamp of claim 1, wherein the laser lighting source is configured to be connected to a power supply provided in the vehicle.

10. The vehicle headlamp of claim 1, wherein a central portion and a periphery of the laser beam have a uniform and high illumination intensity.

* * * * *